US010170059B2

(12) United States Patent
Huang et al.

(10) Patent No.: US 10,170,059 B2
(45) Date of Patent: Jan. 1, 2019

(54) COLOR SEQUENTIAL IMAGE METHOD AND SYSTEM THEREOF

(71) Applicants: WISTRON CORP., New Taipei (TW); NATIONAL CHIAO TUNG UNIVERSITY, Hsinchu (TW)

(72) Inventors: Yi-Pai Huang, Hsinchu (TW); Chi-Wen Chang, Hsinchu (TW); Fang-Cheng Lin, Hsinchu (TW); Han-Ping Shieh, Hsinchu (TW); Meng-Chao Kao, New Taipei (TW); Hui-Chen Lin, New Taipei (TW); Szu-Fen Chen, New Taipei (TW)

(73) Assignees: WISTRON CORP., New Taipei (TW); NATIONAL CHIAO TUNG UNIVERSITY, Hsinchu (TW)

( * ) Notice: Subject to any disclaimer, the term of this patent is extended or adjusted under 35 U.S.C. 154(b) by 74 days.

(21) Appl. No.: 15/261,994

(22) Filed: Sep. 11, 2016

(65) Prior Publication Data

US 2016/0379574 A1 Dec. 29, 2016

Related U.S. Application Data

(62) Division of application No. 13/681,386, filed on Nov. 19, 2012.

(30) Foreign Application Priority Data

Jun. 20, 2012 (TW) ..... 101122062 A

(51) Int. Cl.

| | |
|---|---|
| ***G09G 3/34*** | (2006.01) |
| ***G09G 3/36*** | (2006.01) |
| ***G09G 3/20*** | (2006.01) |

(52) U.S. Cl.

CPC ..... *G09G 3/3413* (2013.01); *G09G 3/2003* (2013.01); *G09G 3/342* (2013.01); *G09G 3/3406* (2013.01); *G09G 3/36* (2013.01); *G09G 3/3611* (2013.01); *G09G 2310/0235* (2013.01); *G09G 2310/08* (2013.01); *G09G 2320/066* (2013.01); *G09G 2320/0646* (2013.01); *G09G 2330/021* (2013.01); *G09G 2360/16* (2013.01)

(58) Field of Classification Search

CPC ..... G09G 3/3406; G09G 2320/0626; G09G 2320/064; G09G 2320/0646

USPC ..... 345/102; 349/61–70; 362/561

See application file for complete search history.

(56) References Cited

U.S. PATENT DOCUMENTS

2010/0090937 A1* 4/2010 Cheng ..... G09G 3/2003 345/88

* cited by examiner

*Primary Examiner* — Ram A Mistry

(74) *Attorney, Agent, or Firm* — CKC & Partners Co., Ltd.

(57) ABSTRACT

A color sequential image method for displaying images using two color fields includes analyzing and sorting percentages of a plurality of colors constituting an input color image, in which a first color possesses a most percentage, a second color possesses a middle percentage, and a third color possesses a third percentage. The method further includes forming a first color field image according to the first color and the third color, and a second color field image according to the second color and the third color.

6 Claims, 7 Drawing Sheets

COLOR SEQUENTIAL IMAGE METHOD AND SYSTEM THEREOF

RELATED APPLICATIONS

The present application is a Divisional Application of the U.S. application Ser. No. 13/681,386, filed Nov. 19, 2012, which claims priority to Taiwanese Application Serial Number 101122062, filed Jun. 20, 2012, all of which are herein incorporated by reference.

BACKGROUND

Field of Invention

This disclosure relates to an image generating method. More particularly, this disclosure relates to a color sequential image method using two color fields.

Description of Related Art

With the growth in the display industry in recent years, the manufacturing process technology of displays is maturing, and the display technology applied to displays continues to improve. Among the various types of displays, field sequential color (FSC) displays, such as projectors and color sequential displays, can realize improvements in display image quality and system efficiency, and can also realize a reduction in production costs.

Field sequential displays operate by displaying sub-frames one at a time, in which each of the sub-frames is composed of a single color that is different from the other sub-frames. The various colors are perceived by human eyes as being mixed. That is, the human eyes will combine the sub-frames that are different in color into a color image. Color sequential displays adjust the color of backlight modules to alter the pixel transmittance ratio or reflection ratio of light gate devices, such as LCD panels, in order to display color images. Therefore, color filters are no longer required and can be omitted from the configuration of the display.

Generally, display technology has been developed such that the backlight strength of each region can be separately adjusted to thereby improve the contrast of a display. This kind of technology can be applied to an LCD with color filters or to a color sequential LCD with no color filters. In view of the response time of liquid crystal cells, color sequential displays need to be implemented using a two color field method, in which a backlight module is utilized to present a rough image that is compensated by liquid crystal technology to present details of an image.

However, improving color quality and visual effect without the use of a color filter is still an area requiring continued attention.

SUMMARY

According to one embodiment of the present disclosure, a color sequential image method for displaying images using two color fields is disclosed. The method includes analyzing and sorting percentages of a plurality of colors constituting an input color image, in which a first color possesses a most percentage, a second color possesses a middle percentage, and a third color possesses a third percentage. The method further includes forming a first color field image according to the first color and the third color, and forming a second color field image according to the second color and the third color.

According to another embodiment of the present disclosure, a color sequential image method for displaying images using two color fields is disclosed. The method includes analyzing and sorting a plurality of percentages of a plurality of colors constituting an input color image, in which a first color possesses a most percentage, a second color possesses a middle percentage, and a third color possesses a third percentage. The method also includes generating a first backlight control signal, a second backlight control signal, and a third backlight control signal which respectively correspond to the first color, the second color, and the third color. The method additionally includes driving a first backlight source and a third backlight source according to the first backlight control signal and the third backlight control signal, in which the first backlight source and the third backlight source correspond to a first color field image. In addition, a second backlight source and the third backlight source are driven according to the second backlight control signal and the third backlight control signal, in which the second backlight source and the third backlight source correspond to a second color field image.

According to another embodiment of the present disclosure, a color sequential image method for displaying images using two color fields includes analyzing and sorting percentages of a plurality of colors derived from a plurality of regions constituting an input color image, in which a first color possesses a most percentage, a second color possesses a middle percentage, and a third color possesses a third percentage in each region. Next, a plurality of first backlight control signals, a plurality of second backlight control signals, and a plurality of third backlight control signals are generated which respectively correspond to the first color, the second color, and the third color. Subsequently, a plurality of first backlight sources and a plurality of third backlight sources of each region are driven according to the first backlight control signals and the third backlight control signals of each region, in which the first backlight sources and the third backlight sources correspond to a first color field image. Next, a plurality of second backlight sources and the third backlight sources of each region are driven according to the second backlight control signals and the third backlight control signals of each region, in which the second backlight sources and the third backlight sources correspond to a second color field image.

According to still another embodiment of the present disclosure, a color sequential image system for displaying images using two color fields is disclosed. An image analyzer of the color sequential image system analyzes and sorts a plurality of percentages of a plurality of colors constituting an input color image, in which a first color possesses the most percentage, a second color possesses the middle percentage, and a third color possesses a third percentage. A first backlight controller of the color sequential image system generates at least one corresponding first backlight control signal according to one or more properties of the first color for driving a first color backlight source. A second backlight controller of the color sequential image system generates at least one corresponding second backlight control signal according to one or more properties of the second color for driving a second color backlight source. A third backlight controller of the color sequential image system generates at least one corresponding third backlight control signal according to one or more properties of the third color for driving a second color backlight source, in which color lights emitted from the first color backlight source and the second color backlight source form a first color image, and color lights emitted from the second color backlight source and the third color backlight source form a second color image.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
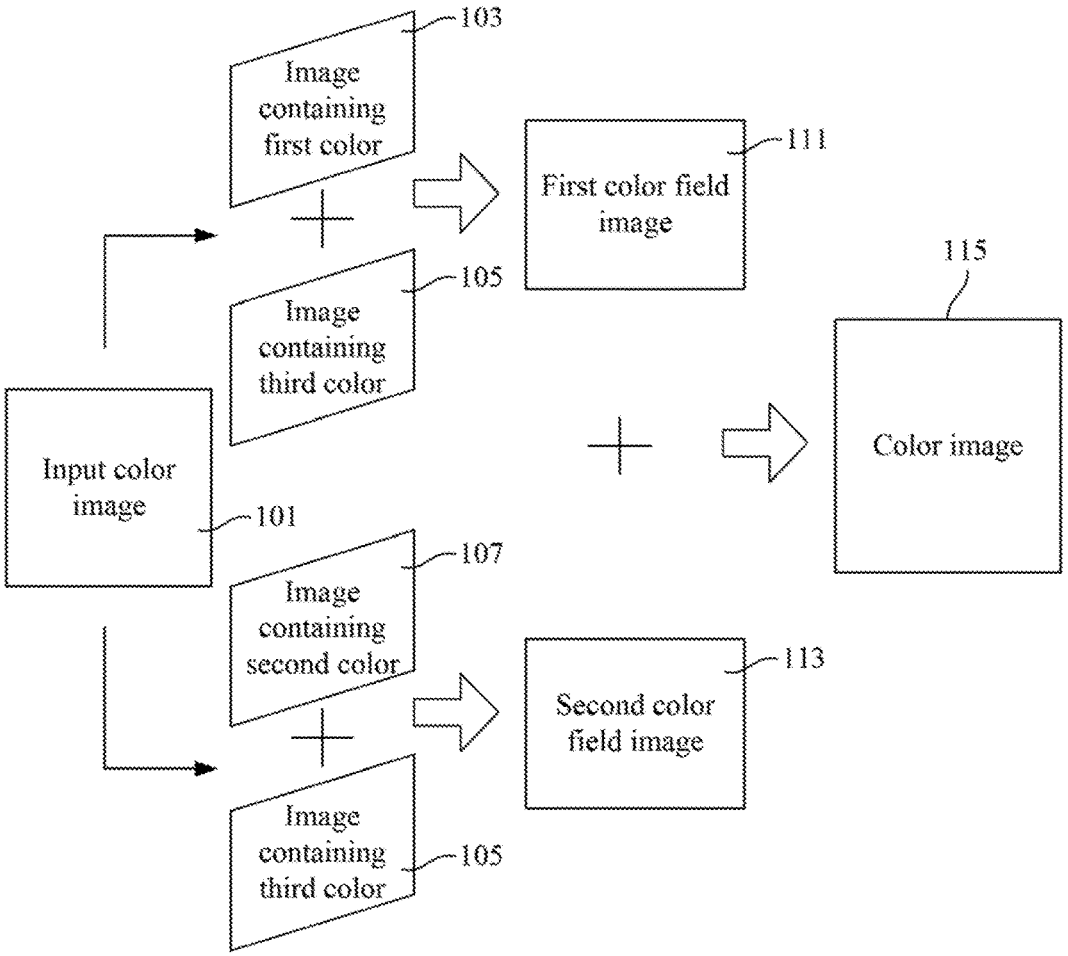
FIG. 1A is a schematic diagram of a color sequential image method for displaying images using two color fields according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

The color sequential image method and system using two color fields of the following embodiments can be applied to display panels of various sizes, such as TVs, computer screens, mobile phone screens, or large public information boards. In the method and system, an input color image is first analyzed to determine which color has the least information, and this color is targeted for division. A first color field image is a displayed image with two mixed colors, and the remaining color information which is not shown is displayed in a subsequent second color field image. In the method and system, the color with the least information is sacrificed, and regionally controlled color backlight modules are used, such that realized colors are even closer to the colors of actual objects.

After an LED driving signal of each region is decided, light coming from various regions is combined to determine the color and light of the whole image. During this process, the various lights coming from the different regions influence each other, and the distribution of the light for each color is different. Therefore, the light distribution needs to be adjusted to optimize the images.

Figure 1B:
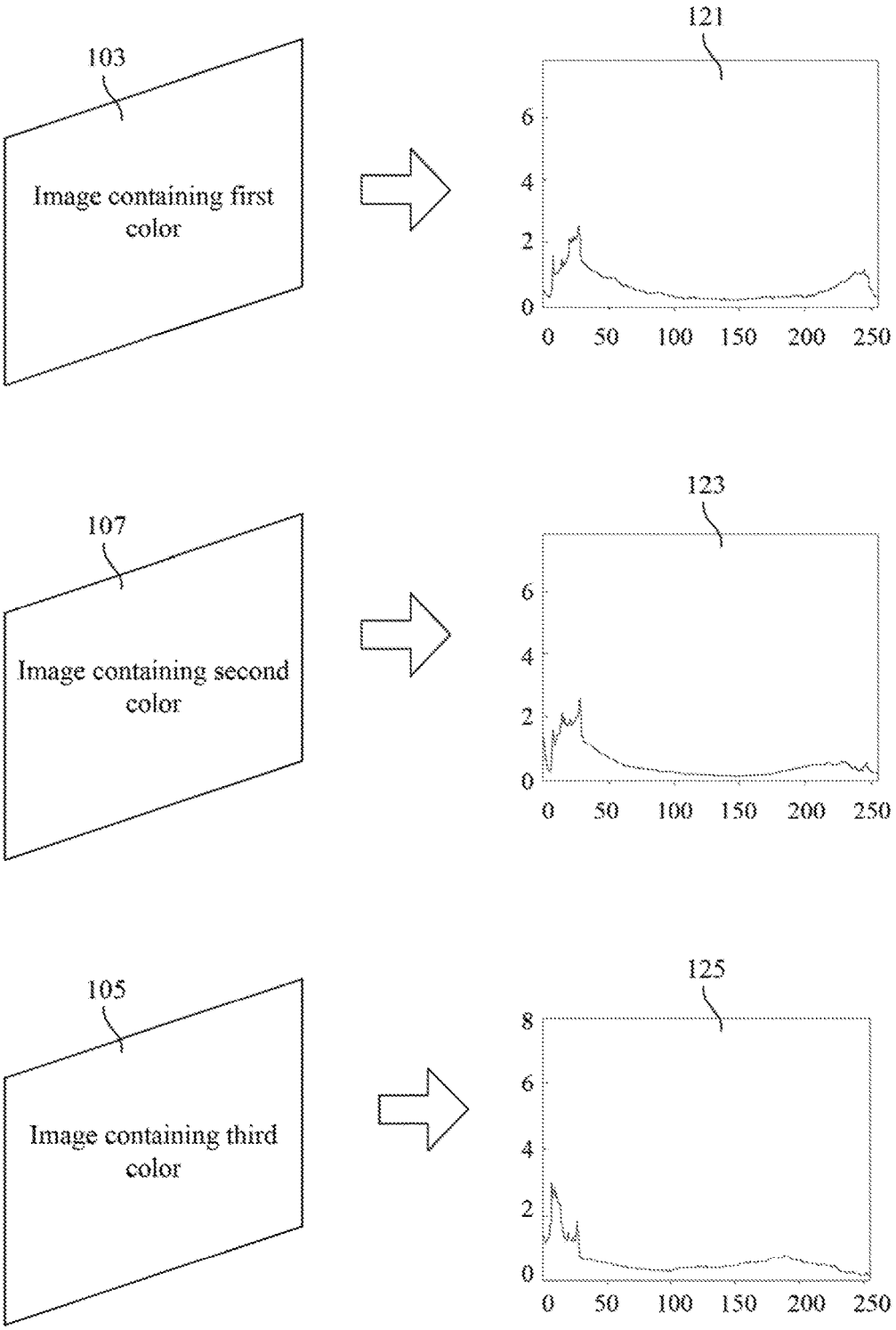
FIG. 1B is a histogram of various colors according to one embodiment of this disclosure.

FIG. 1A is a schematic diagram of a color sequential image method for displaying images using two color fields according to one embodiment of the present disclosure, and FIG. 1B is a histogram of various colors according to one embodiment of this disclosure. In the color sequential image method, analysis is first performed to determine which color in an input color image 101 has the least information. The color carrying the least information is designated as a third color, while the colors carrying the most information and the middle information (i.e., a middle amount of information) are designated as a first color and a second color, respectively.

Next, an image 103 containing the first color, an image 105 containing the third color, and an image 107 containing the second color are respectively formed. A first color histogram 121, a second color histogram 123, and a third color histogram 125 respectively of the image 103 containing the first color, the image 107 containing the second color, and the image 105 containing the third color are shown in FIG. 1B. Next, the image 103 containing the first color and the image 105 containing the third color are combined to form the first color field image 111. Similarly, the image 107 containing the second color and image 105 containing the third color are combined to form the second color field image 113. Subsequently, the first color field image 111 and the second color field image 113 are combined to form an output color image 115.

In addition, two liquid crystal compensation signals are generated according to the color possessing the most information amount and the color possessing the middle information amount. The third color possessing the least information amount is divided into two parts according to the liquid crystal compensation signals derived according to the other colors, such that the color possessing least information does not block the colors possessing more information. Specifically, if the input color image is formed through combing the essential colors of red, green, and blue, in which the color among the three colors which possess the least information amount is first divided then combined with the other two colors, the chromatism of the displayed re-formed image resulting from the two color fields is invisible to the human eye. As a result, the image quality is improved over that when a particular color is sacrificed.

Figure 2:
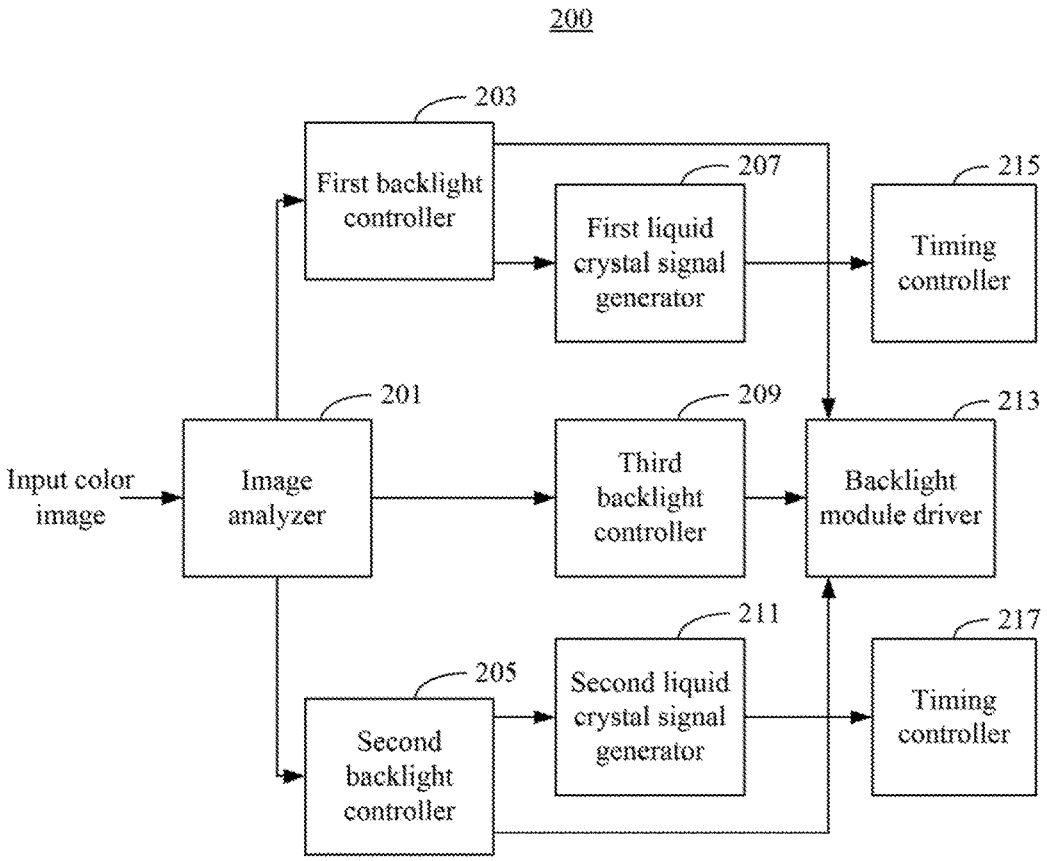
FIG. 2 is a block diagram of a color sequential image system for displaying images using two color fields according to one embodiment of the present disclosure.

FIG. 2 is a block diagram of a color sequential image system for displaying images using two color fields according to one embodiment of the present disclosure. The color sequential image system 200 includes an image analyzer 201, a first backlight controller 203, a second backlight controller 205, a third backlight controller 209, and a backlight module driver 213.

The image analyzer 201 analyzes and sorts percentages of a number of colors which constitute an input color image, in which a first color possesses the most percentage, a second color possesses the middle percentage, and a third color possesses a third percentage. In detail, information amounts corresponding to the first color, the second color, and the third color of the input color image are individually accumulated to obtain the percentages of the first color, the second color, and the third color. These colors can be red, green, and blue, that is, the essential colors.

The first backlight controller 203 generates a first backlight control signal according to the properties of the first color for driving a first color backlight source, such as blue LEDs, to emit light. The second backlight controller 205 generates a second backlight control signal according to the properties of the second color for driving a second color backlight source, such as green LEDs, to emit light. The third backlight controller 209 generates a third backlight control signal according to the properties of the third color for driving a third color backlight source, such as red LEDs, for emitting light. The properties of each of these colors may include color intensity, color distribution, and color density which correspond to certain figures and certain lines.

The backlight module driver 213 drives first, second and third color backlight sources of the backlight module (not shown) according to the first backlight control signal, the second backlight control signal, and the third backlight control signal. Color light emitted from the first color backlight source and the second color backlight source forms a first color image, and color light emitted from the second color backlight source and the third color backlight source form a second color image. These two color images are combined to form a preliminary output image.

The color sequential image system further includes a first liquid crystal signal generator 207 and a second liquid crystal signal generator 211. The first liquid crystal signal generator 207 generates a first liquid crystal compensation signal according to the first backlight control signal to adjust the brightness of the first color field image through the timing controller 215. The second liquid crystal signal generator 211 generates a second liquid crystal compensation signal according to the second backlight control signal to adjust the brightness of the second color field image through the timing controller 217.

Figure 3:
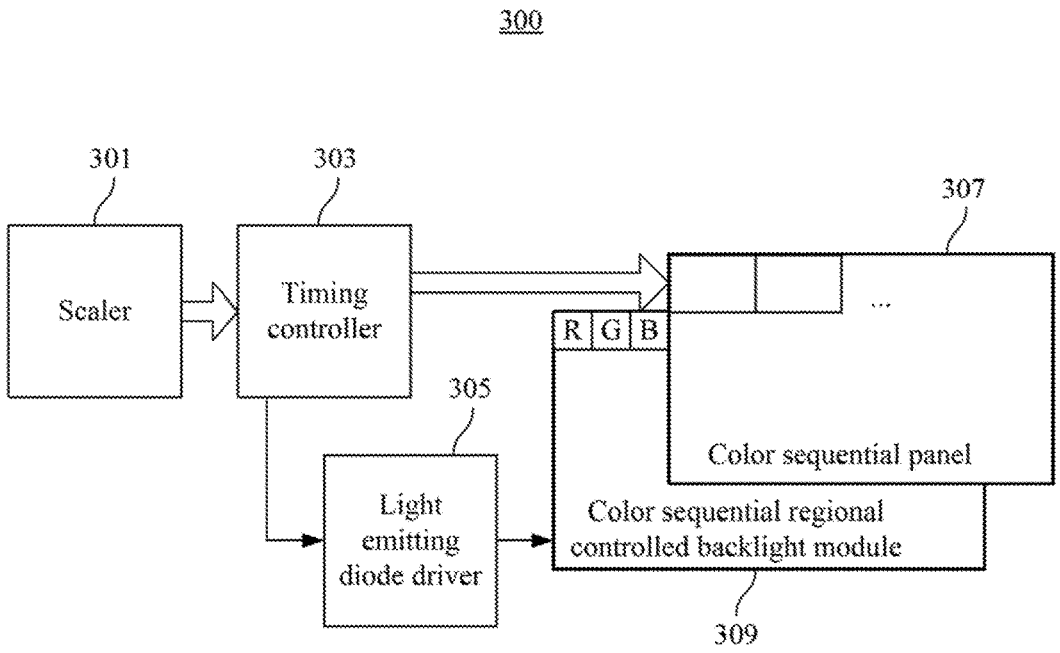
FIG. 3 is a block diagram of a color sequential image system for displaying images using two color fields according to another embodiment of the present disclosure.

FIG. 3 is a block diagram of a color sequential image system for displaying images using two color fields according to another embodiment of this invention. The color sequential image system 300 includes a scaler 301, a timing controller 303, a light emitting diode driver 305, a color sequential panel 307, and a color sequential regional controlled backlight module 309.

The timing controller 303 receives a control signal from the scaler 301 and passes the control signal to each of the light emitting diode driver 305 and the color sequential panel 307. The light emitting diode driver 305 drives light sources that emit light of various colors of the backlight module 309 to emit the light of various colors at different times. For example, the light sources can emit green and red light first, and emit blue and red light next. Because the backlight module 309 can generate light of various colors, the color sequential panel 307 does not require a color filter.

The backlight module 309 has a local dimming (or area control) function, and hence, the brightness of the backlight module 309 can be regionally controlled according to the brightness of the video frame. As a result, the backlight sources can be driven by region, and all of the backlight sources need not be driven at the same time, such that power can be saved. In addition, the field color of the color sequential method and regional backlight control can be decided by the timing controller 303.

Figure 4:
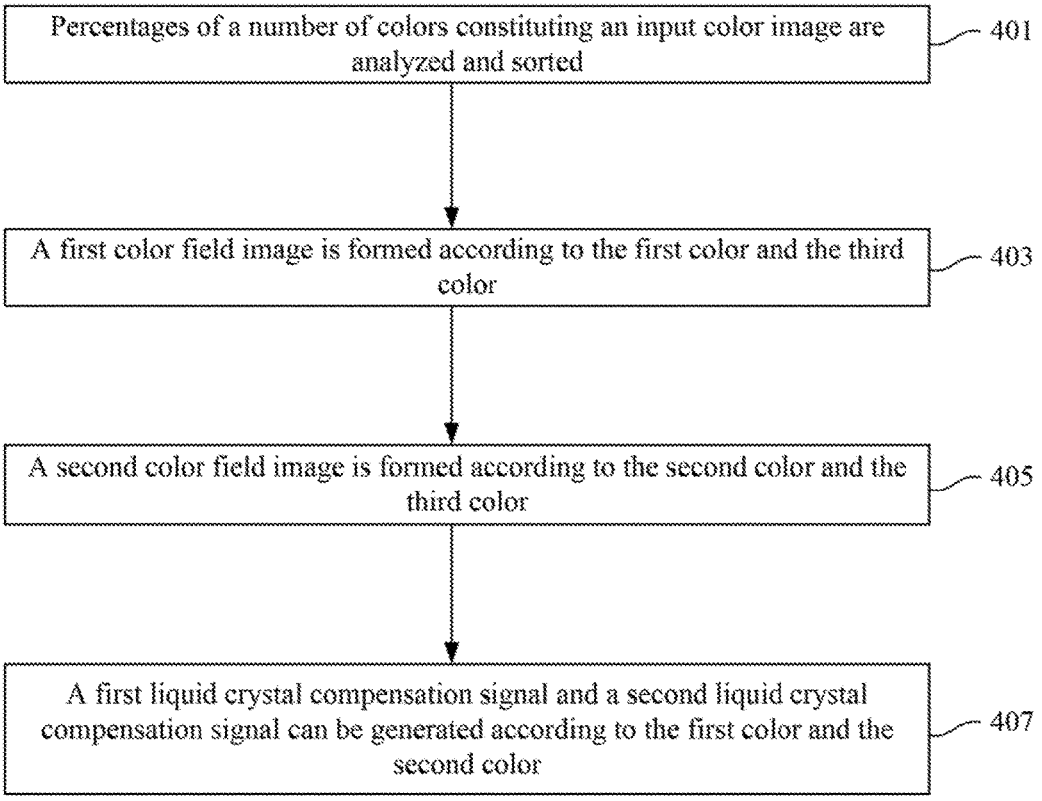
FIG. 4 is a flowchart of a color sequential image method for displaying images using two color fields according to one embodiment of the present disclosure.

FIG. 4 is a flowchart of a color sequential image method for displaying images using two color fields according to one embodiment of the present disclosure. In this method, percentages of a number of colors constituting an input color image are analyzed and sorted (step 401), in which information amounts corresponding to a first color, a second color, and a third color of the input color image are individually accumulated to obtain the percentages of the first color, the second color, and the third color. The first color possesses the most percentage, the second color possesses the middle percentage, and the third color possesses a third percentage. These colors can be red, blue, or green.

Next, a first color field image is formed according to the first color and the third color (step 403), and a second color field image is formed according to the second color and the third color (step 405). The first color field image is displayed before the second color field image is displayed. Furthermore, a first liquid crystal compensation signal and a second liquid crystal compensation signal can be generated according to the first color and the second color (step 407) to adjust the brightness of the first color field image and the second color field image.

Instead of sacrificing a certain color, the method of this embodiment first finds out which color in the entire image has the least information and divides the color with the least information to be displayed separately, which makes the realized colors even closer to the colors of actual objects.

Figure 5:
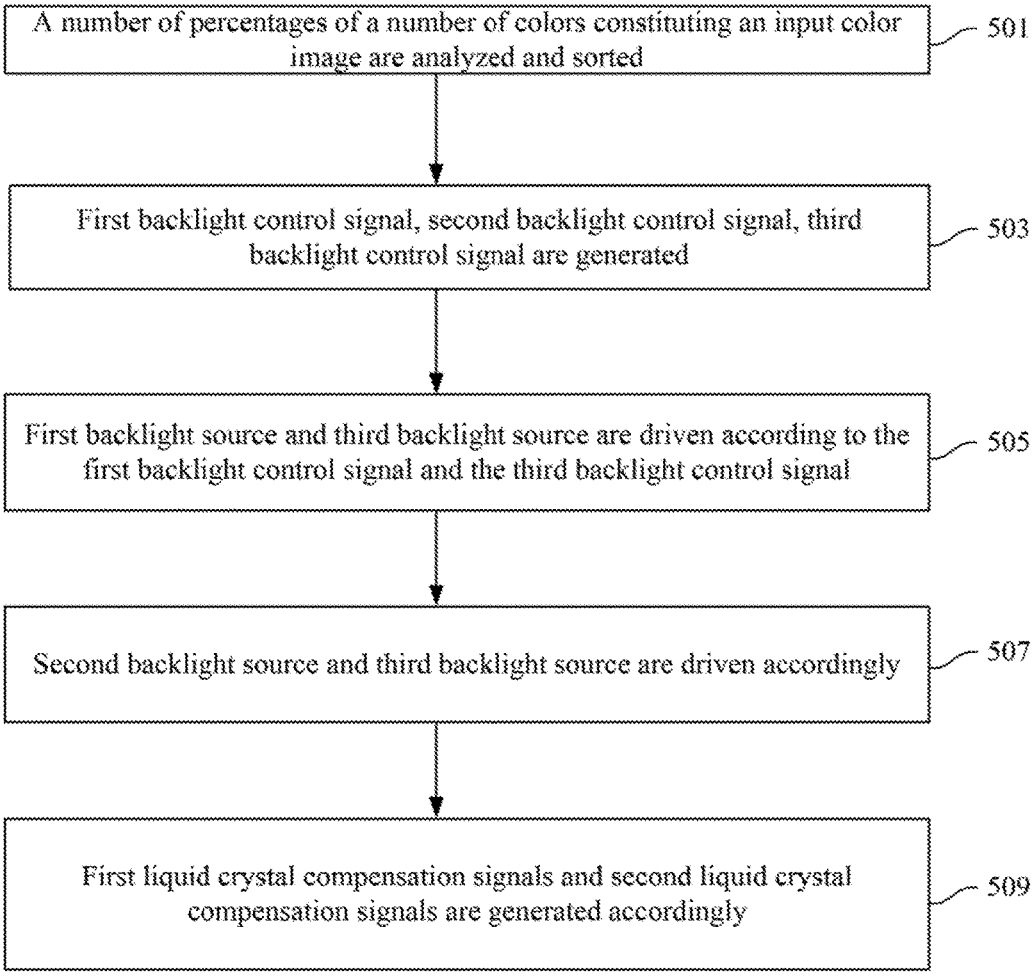
FIG. 5 is a flowchart of a color sequential image method for displaying images using two color fields according to another embodiment of the present disclosure.

FIG. 5 is a flowchart of a color sequential image method for displaying images using two color fields according to another embodiment of the present disclosure. A number of percentages of a number of colors constituting an input color image are analyzed and sorted (step 501), in which a first color possesses the most percentage, a second color possesses the middle percentage, and a third color possesses a third percentage. The colors can be red, green, and blue. Next, a first backlight control signal, a second backlight control signal, and a third backlight control signal are generated (step 503), in which the backlight control signals respectively correspond to the first color, the second color, and the third color.

After step 503, a first backlight source and a third backlight source are driven according to the first backlight control signal and the third backlight control signal (step 505), in which the first backlight source and the third backlight source correspond to a first color field image. Next, a second backlight source and the third backlight source are driven according to the second backlight control signal and the third backlight control signal (step 507), in which the second backlight source and the third backlight source correspond to a second color field image. Specifically, the method of this embodiment first displays the first color field image and displays the second color field image next. These images are mixed by human eyes due to the persistence of vision phenomenon, and a full color image can be presented to the retina.

Further, first liquid crystal compensation signals and second liquid crystal compensation signals are generated according to the first backlight control signal and the second backlight control signal (step 509) to adjust the brightness of the first color field image and the second color field image. For example, if the color sorted according to the information amount and listed from most to least is blue, green, and red, the liquid crystal compensation signals are calculated according to the blue and green information. Subsequently, the red information is processed with the blue and green liquid crystal compensation signals. There is no need for individually calculating the liquid crystal compensation signal for red.

Figure 6:
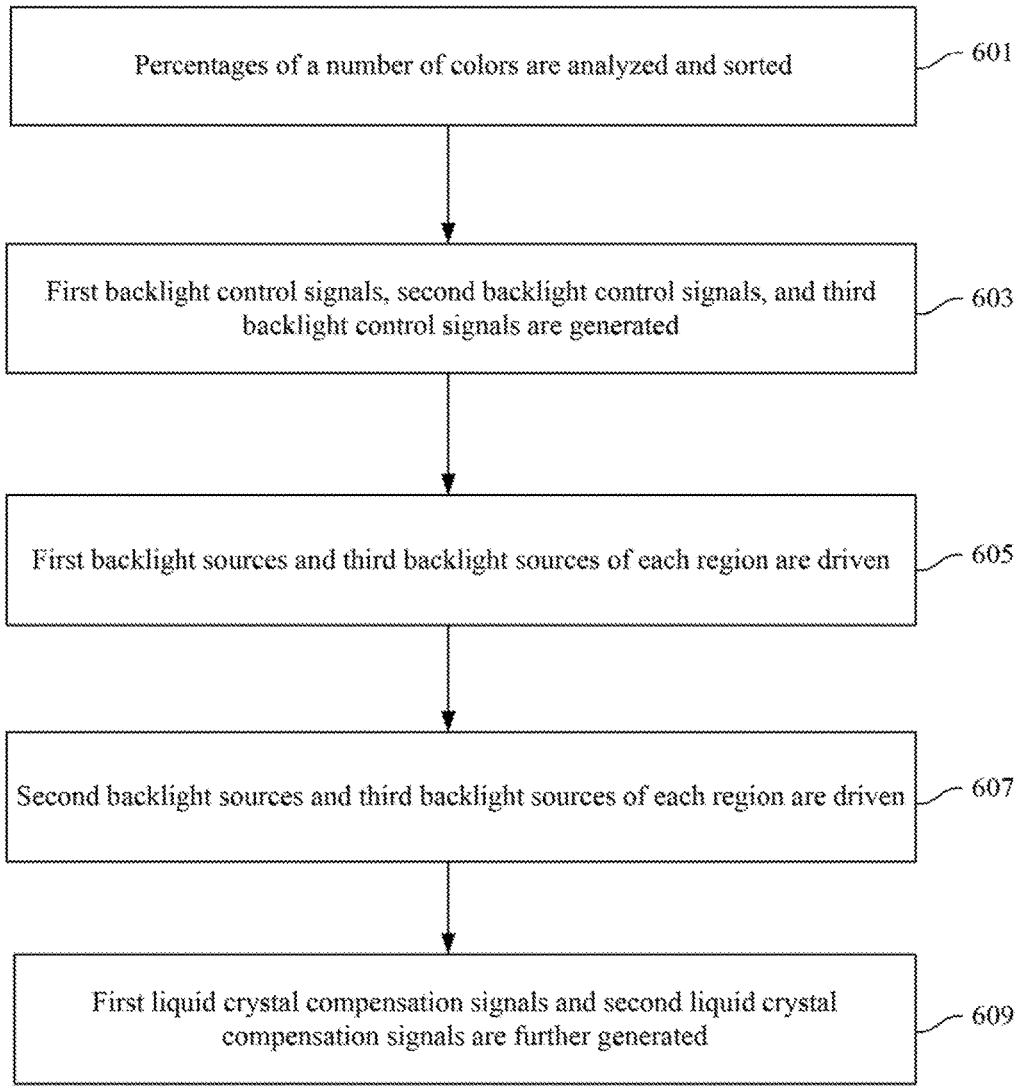
FIG. 6 is a flowchart of a color sequential image method for displaying images using two color fields according to still another embodiment of the present disclosure.

FIG. 6 is a flowchart of a color sequential image method for displaying images using two color fields according to still another embodiment of the present disclosure. In this method, percentages of a number of colors derived from a number of regions constituting an input color image are analyzed and sorted (step 601), in which a first color possesses the most percentage, a second color possesses the middle percentage, and a third color possesses a third percentage in each region. Next, a number of first backlight control signals, a number of second backlight control signals, and a number of third backlight control signals which respectively correspond to the first color, the second color, and the third color are generated (step 603).

After step 603, the local dimming (or area control) technology is employed to drive various first backlight sources and various third backlight sources of each region according to the first backlight control signals and third backlight control signals of each region (step 605), in which the first backlight sources and the third backlight sources correspond to a first color field image. Subsequently, various second backlight sources and various third backlight sources of each region are driven according to the second backlight control signals and the third backlight control signals of each region (step 607), in the which the second backlight sources and the third backlight sources correspond to a second color field image. As determined through simulation, the optimal region number for the color sequential image method using two color fields is 80×45. However, the region number can be decreased to 32×24 in order to simplify the circuit and reducing costs.

The method of this embodiment first displays the first color field image and displays the second color field image next. These images can be mixed and combined by human eyes due to the persistence of vision phenomenon, and a full color image can be presented to the retina. With the local dimming technology, the states of backlighting in each region is calculated and adjusted according to the brightness states of the physical object. All the backlight sources need not to be driven frequently, power can be saved, light leakage is reduced and the dynamic contrast is improved. Each color field can display a color image, and the color effect is decided from the two colors having more information in each region. Therefore, each sub-frame contains various colors to thereby achieve a full color image.

In addition, a number of first liquid crystal compensation signals and a number of second liquid crystal compensation signals are further generated according to the first backlight control signals and the second backlight control signals of each region to adjust the brightness of the first color field image and the second color field image (step 609). A threshold is set to prevent changing the main color as a result of a slight change in the image. When the image variation is slight and does not exceed the threshold, the main color of the color field is kept the same to keep the image stable. On the other hand, the main color of the color field is changed only when the image variation exceeds the threshold.

The color sequential image method and system using two color fields of the above embodiments analyzes an input color image to determine which color possess the least information, and the color that has the least information is divided into two parts according to the liquid crystal signals calculated according to the remaining two colors. Thus, the color possessing less information will neither block nor interfere with colors possessing more information. Furthermore, the information amount corresponding to each region can be analyzed according to each region, and the color in the region possessing the least information is targeted for division, thereby reducing the color distortion phenomenon.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A color sequential image method for displaying ages using two color fields, the method comprising:

analyzing and sorting a plurality of colors in an input color image by percentages occupied in the input color image, wherein a first color occupies a largest percentage of the input color image, a second color occupies a middle percentage of the input color image, a third color occupies a smallest percentage of the input color image, and a sum of the percentages of the first, second and third colors equals one hundred percent of the input image;

generating a plurality of backlight control signals, wherein the backlight control signals comprises a first backlight control signal, a second backlight control signal, and a third backlight control signal which respectively correspond to the first color, the second color, and the third color;

driving two backlight sources according to a first set of two corresponding ones of the backlight control signals to form a first color field; and driving two backlight sources according to a second set of two corresponding ones of the backlight control signals to form a second color field;

wherein the first set and the second set are different, and the third backlight control signal is in both the first set and the second set.

2. The color sequential image method as claimed in claim 1, wherein information amounts corresponding to the first color, the second color, and the third color of the input color image are individually accumulated to obtain the percentages of the first color, the second color, and the third color.

3. The color sequential image method as claimed in claim 1, further comprising:

generating a first liquid crystal compensation signal and a second liquid crystal compensation signal according to the first backlight control signal and the second backlight control signal to adjust the brightness of a first color field image and a second color field image.

4. The color sequential image method as claimed in claim 1, wherein the colors are red, green, and blue.

5. The color sequential image method as claimed in claim 1, wherein a first color field image is displayed before a second color field image is displayed.

6. The color sequential image method as claimed in claim 1, further comprising:

setting a threshold related to an amount of image variation;

when the amount of image variation does not exceed the threshold, keeping a main color of the first color field image and of the second color field image the same; and when the amount of image variation exceeds the threshold, changing the main color of the first color field image and of the second color field image.

* * * * *